US012544681B2

(12) United States Patent
Godoy

(10) Patent No.: US 12,544,681 B2
(45) Date of Patent: Feb. 10, 2026

(54) INFLATABLE HOLIDAY DECORATION DEVICE

(71) Applicant: James Godoy, Canyon Lake, CA (US)

(72) Inventor: James Godoy, Canyon Lake, CA (US)

( * ) Notice: Subject to any disclaimer, the term of this patent is extended or adjusted under 35 U.S.C. 154(b) by 318 days.

(21) Appl. No.: 18/201,261

(22) Filed: May 24, 2023

(65) Prior Publication Data

US 2024/0390811 A1 Nov. 28, 2024

(51) Int. Cl.
*A63H 27/10* (2006.01)

(52) U.S. Cl.
CPC ..... *A63H 27/10* (2013.01); *A63H 2027/1008* (2013.01); *A63H 2027/1058* (2013.01); *A63H 2027/1075* (2013.01)

(58) Field of Classification Search
CPC ..... A63H 27/10; A63H 2027/1008; A63H 2027/1058; A63H 2027/1075
See application file for complete search history.

(56) References Cited

U.S. PATENT DOCUMENTS

D372,205 S 7/1996 Mason
6,644,843 B2 11/2003 Chin-Cheng
7,302,769 B2 * 12/2007 Machala ..... G09F 15/0025 446/179
D850,976 S 6/2019 Lewis
11,484,808 B2 11/2022 Moore
2010/0029169 A1 2/2010 Lin
2012/0190269 A1 * 7/2012 Duncan ..... A63H 3/06 446/226
2017/0072328 A1 3/2017 Sze
2019/0318673 A1 10/2019 Newton
2023/0191272 A1 * 6/2023 Wang ..... G09F 19/08 446/226

FOREIGN PATENT DOCUMENTS

CA 2526557 5/2006
CA 2526763 5/2006

* cited by examiner

*Primary Examiner* — John A Ricci

(57) ABSTRACT

An inflatable holiday decoration device includes a balloon structured to resemble a holiday character when the balloon is inflated. The balloon has a weighted base to facilitate the balloon to remain stationary on a support surface. A plurality of light emitters is each integrated into the balloon having each of the plurality of light emitters being directed into an interior of the balloon for illuminating the interior of the balloon. A charger includes a panel and a stake extending downwardly from a bottom surface of the panel. The stake tapers to a pointed end which can penetrate the support surface having the panel is spaced upwardly from the support surface. The charger is in communication with the plurality of light emitters for powering the light emitters.

5 Claims, 5 Drawing Sheets

INFLATABLE HOLIDAY DECORATION DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to inflatable decoration devices and more particularly pertains to a new inflatable decoration device for celebrating a holiday. The device includes a balloon that has a weighted base for standing the balloon in an upright orientation and a plurality of light emitters integrated into the balloon for illuminating an interior of the balloon. The device includes a power supply that includes a solar panel and a rechargeable battery to facilitate the balloon to be located in any location without being tethered to an electrical outlet.

(2) Description of Related Art Including Information Disclosed Under 37 CFR 1.97 and 1.98

The prior art relates to inflatable decoration devices including a variety of illuminated balloon devices that each includes an electromechanical inflation unit for inflating the balloon device and a plurality of light emitters for illuminating the balloon device. Furthermore, the prior art discloses a variety of illuminated balloon devices that each includes a rigid support frame. In no instance does the prior art disclose a balloon device that can remain inflated for an extended period of time and light emitters and a solar powered charger to power the light emitters.

BRIEF SUMMARY OF THE INVENTION

An embodiment of the disclosure meets the needs presented above by generally comprising a balloon structured to resemble a holiday character when the balloon is inflated. The balloon has a weighted base to facilitate the balloon to remain stationary on a support surface. A plurality of light emitters is each integrated into the balloon having each of the plurality of light emitters being directed into an interior of the balloon for illuminating the interior of the balloon. A charger includes a panel and a stake extending downwardly from a bottom surface of the panel. The stake tapers to a pointed end which can penetrate the support surface having the panel is spaced upwardly from the support surface. The charger is in communication with the plurality of light emitters for powering the light emitters.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
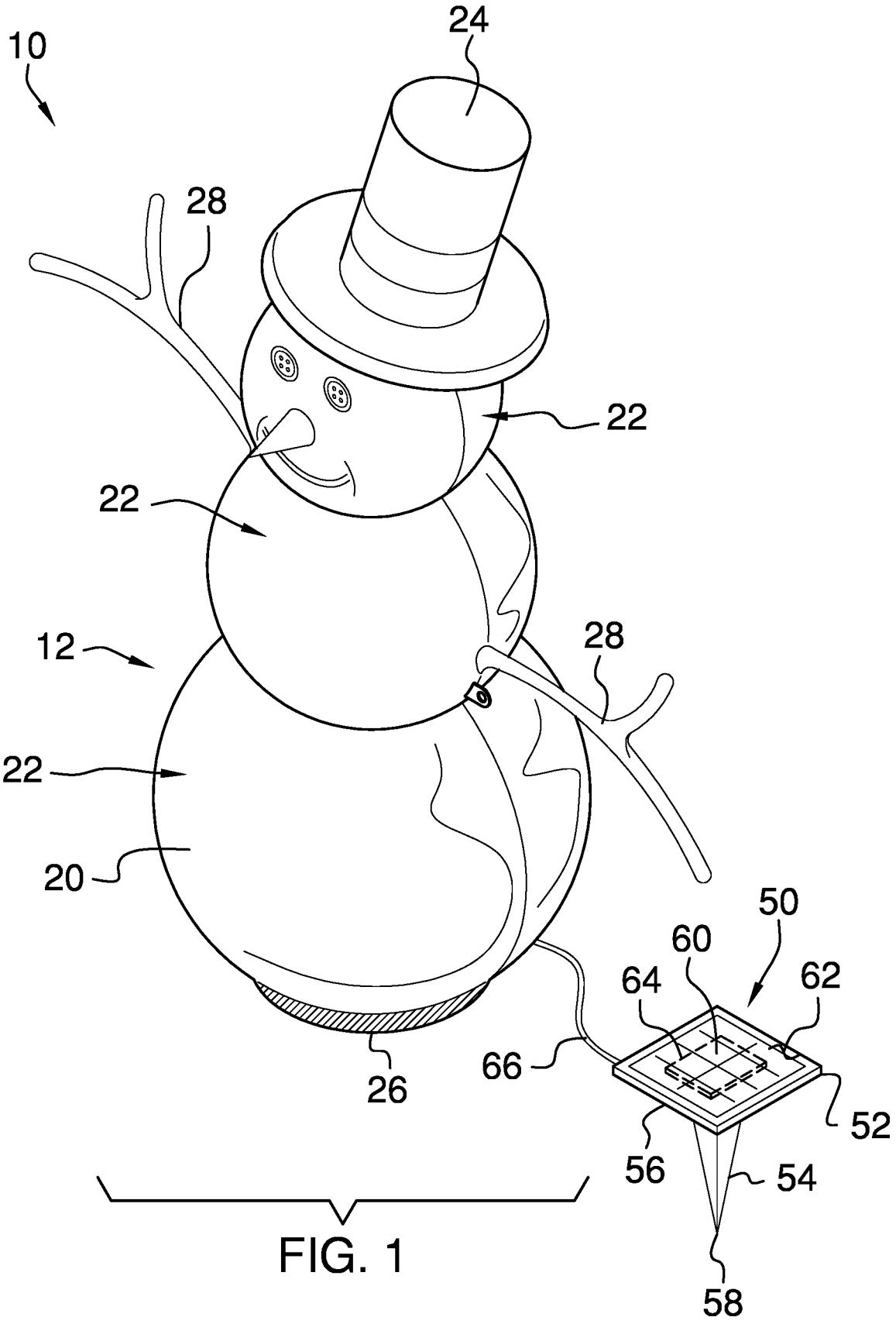
FIG. 1 is a front perspective view of an inflatable holiday decoration device according to an embodiment of the disclosure.
Figure 2:
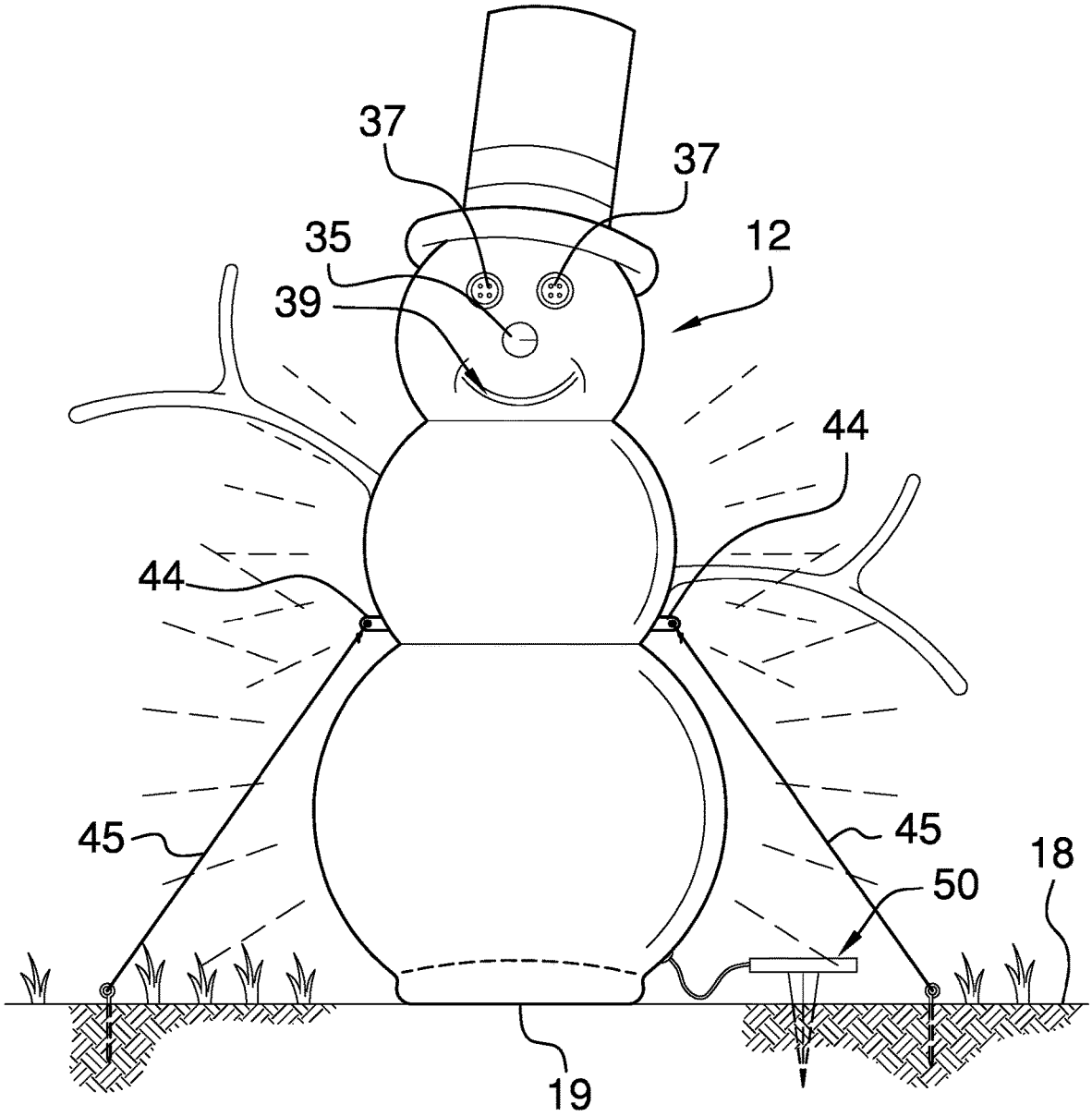
FIG. 2 is a front in-use view of an embodiment of the disclosure.
Figure 3:
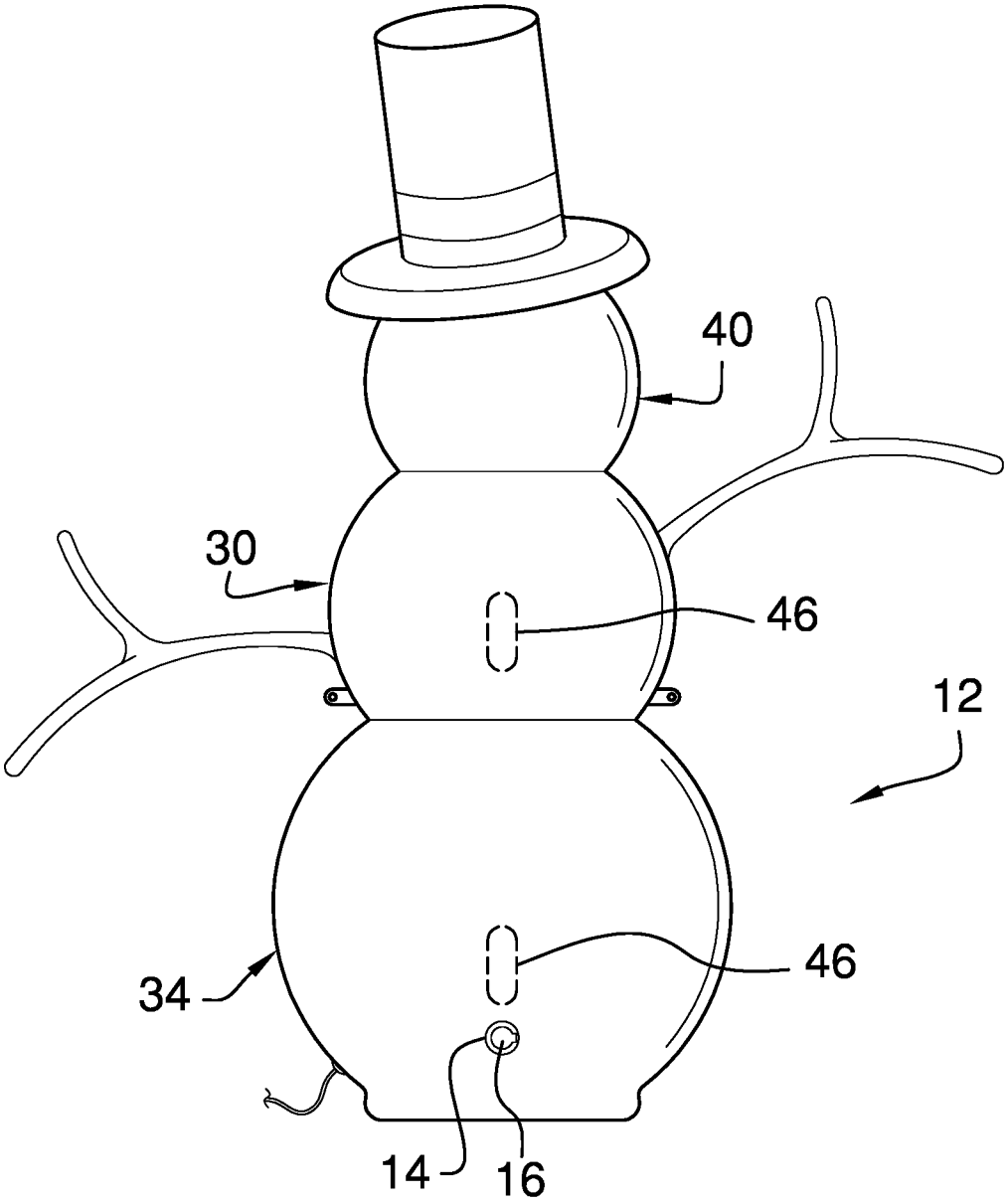
FIG. 3 is a back phantom view of an embodiment of the disclosure.
Figure 4:
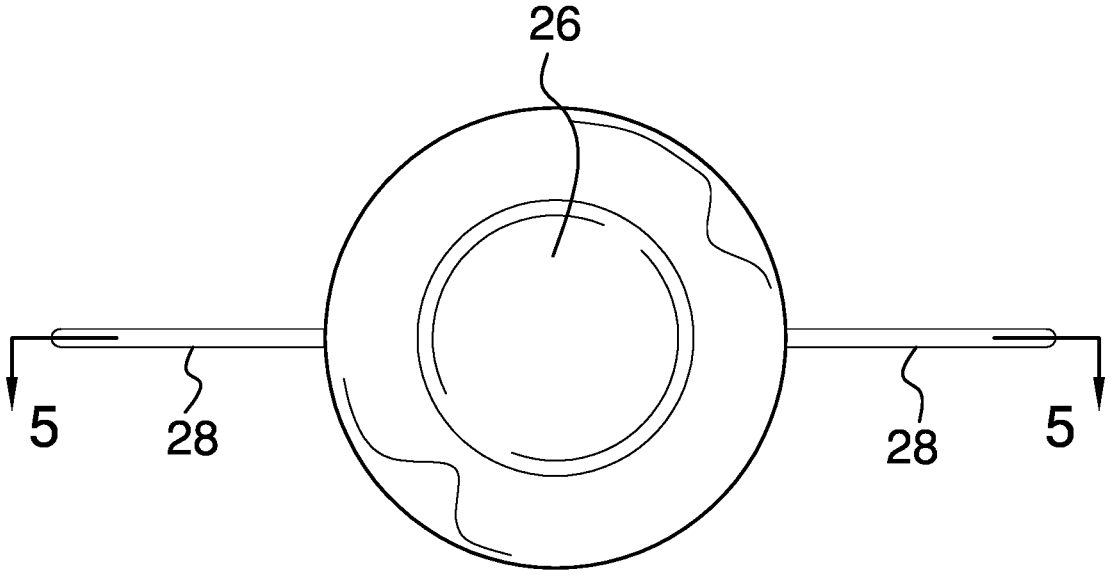
FIG. 4 is a bottom view of an embodiment of the disclosure.
Figure 5:
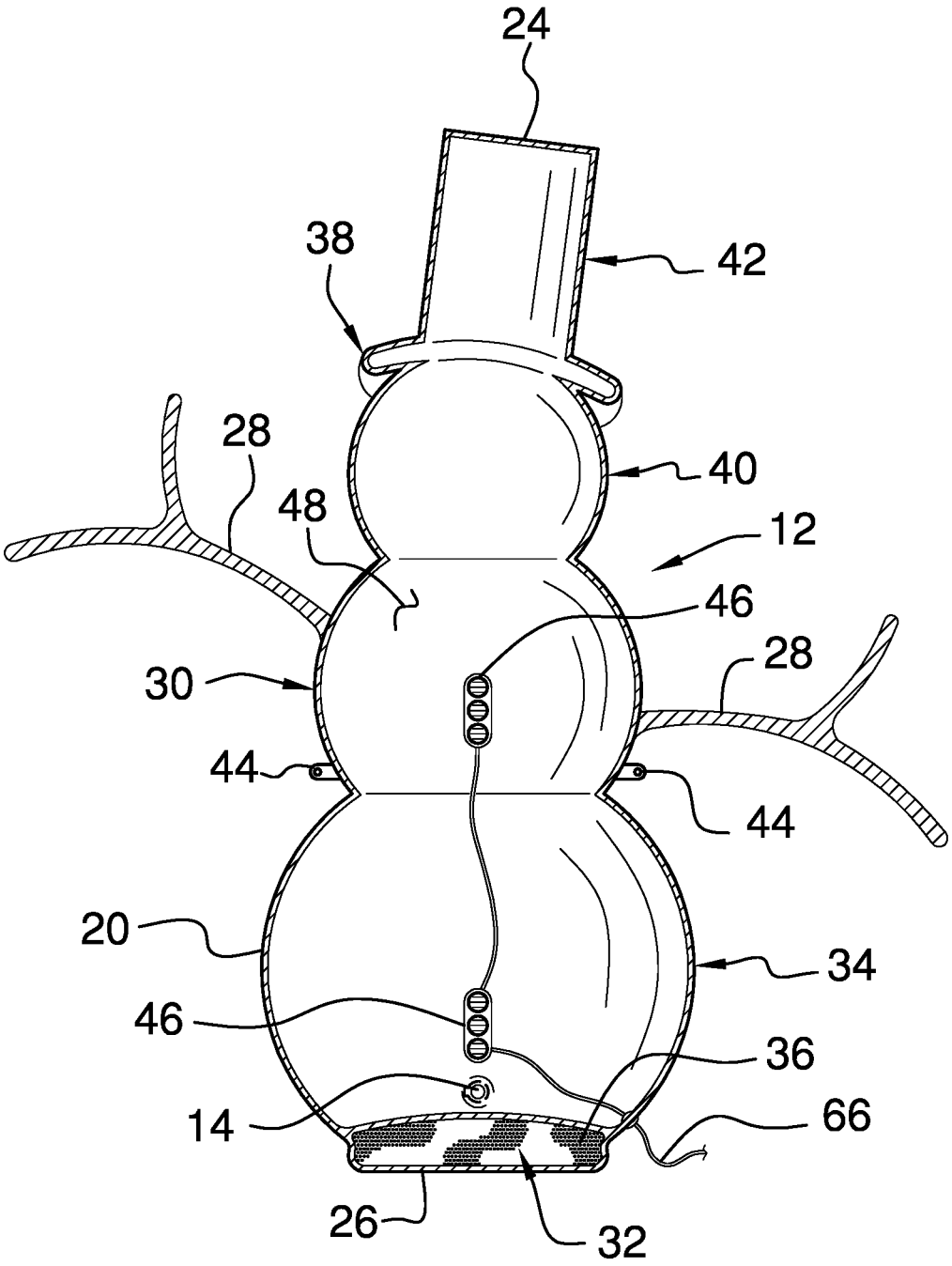
FIG. 5 is a cross sectional view taken along line 5-5 of FIG. 4 of an embodiment of the disclosure.

With reference now to the drawings, and in particular to FIGS. 1 through 5 thereof, a new inflatable decoration device embodying the principles and concepts of an embodiment of the disclosure and generally designated by the reference numeral 10 will be described.

As best illustrated in FIGS. 1 through 5, the inflatable holiday decoration device 10 generally comprises a balloon 12 that is structured to resemble a holiday character when the balloon 12 is inflated. The balloon 12 has a fill port 14 that is in fluid communication with an interior of the balloon 12 for inflating or deflating the balloon 12. The fill port 14 includes a closure 16 for closing the fill port 14 thereby facilitating the balloon 12 to remain inflated for an extended period of time. Furthermore, the balloon 12 has a weighted base 19 to facilitate the balloon 12 to remain stationary on a support surface 18.

The balloon 12 has an outer wall 20 which has a series of spherical portions 22 that are distributed between a top end 24 and a bottom end 26 of the balloon 12 such that the balloon 12 has the ornamental appearance of a snowman. The outer wall 20 has a pair of arm portions 28 each extending in opposite directions from a middle one of the plurality of spherical portions 30. Additionally, each of the arm portions 28 is forked such that each of the arm portions 28 has the ornamental appearance of sticks used as snowman arms. The balloon 12 has a chamber 32 which is integrated into a bottom one of the spherical portions 34 of the outer wall 20 having the chamber 32 being aligned with the bottom end 26 of the balloon 12. The bottom end 26 is flattened such that the bottom end 26 defines the weighted base 19. The chamber 32 is filled with a granular material 36 to inhibit the balloon 12 from tipping over when the balloon 12 is stood upon the bottom end 26. A top one of the spherical portions 40 includes a conical protrusion 35 to resemble a carrot nose of a snowman and a pair of disk portions 37 to resemble button eyes of a snowman and an image of a smile 39.

The fill port 14 extends through the outer wall 20 associated with the bottom spherical portion 34 at a point positioned closer to the bottom end 26 than the middle spherical portion 30. The outer wall 20 has a ridge 38 extending outwardly from the top spherical portion 40 and a cylindrical portion 42 extending upwardly from the ridge 38. In this way the ridge 38 and the cylindrical portion 42 have the ornamental appearance of a top hat. The outer wall 20 has a pair of anchors 44 each extending laterally away in opposite directions from the middle spherical portion 30. Each of the anchors 44 can be attached to a respective one of a pair of anchoring wires 45 to secure the balloon 12 in a selected location. The outer wall 20 of the balloon 12 may have a variety of different structural features to facilitate the balloon 12 to have the ornamental appearance of a wide variety of holiday characters or other fictional characters.

A plurality of light emitters 46 is each integrated into the balloon 12 having each of the plurality of light emitters 46 being directed into an interior of the balloon 12. In this way each of the plurality of light emitters 46 can emit light into the balloon 12 for illuminating the interior of the balloon 12. Each of the light emitters 46 is attached to an inside surface 48 of the outer wall 20 corresponding to a respective one of the bottom spherical portion 34 and the middle spherical portion 30. Additionally, each of the light emitters 46 may comprise a light emitting diode or other type of electronic light emitter that can emit light in a variety of colors.

A charger 50 is included which has a panel 52 and a stake 54 extending downwardly from a bottom surface 56 of the panel 52. The stake 54 tapers to a pointed end 58 to facilitate the pointed end 58 to penetrate the support surface 18 having the panel 52 being spaced upwardly from the support surface 18. The charger 50 includes a solar panel 60 that is integrated into a top surface 62 of the panel 52 such that the solar panel 60 is exposed to sunlight when the stake 54 is inserted into the support surface 18. The charger 50 includes a rechargeable battery 64 that is integrated into the panel 52 and the rechargeable battery 64 is electrically coupled to the solar panel 60 thereby facilitating the solar panel 60 to charge the rechargeable battery 64. The charger 50 includes a power cord 66 that is coupled between the panel 52 and the bottom spherical portion 34 of the outer wall 20 of the balloon 12. The power cord 66 is electrically coupled to the rechargeable battery 64 and the power cord 66 is electrically coupled to each of the plurality of light emitters 46.

In use, the balloon 12 is inflated either by blowing into the fill port 14 or with some other source of air and the balloon 12 is stood upon the bottom end 26 of the balloon 12. The stake 54 is inserted into the support surface 18 to facilitate the solar panel 60 to be exposed to sunlight for charging the rechargeable battery 64. In this way the light emitters 46 can be operated without requiring access to an electrical outlet. Thus, the balloon 12 can be employed in virtually any location for ornamental purposes. Each of the anchors 44 can be secured to an anchor line 46 for securing the balloon 12 in the selected location. The closure 16 on the fill port 14 can be opened at any time to deflate the balloon 12 for storage.

With respect to the above description then, it is to be realized that the optimum dimensional relationships for the parts of an embodiment enabled by the disclosure, to include variations in size, materials, shape, form, function and manner of operation, device and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An inflatable holiday decoration device being positionable anywhere without being tethered to an electrical outlet, said device comprising:

a balloon being structured to resemble a holiday character when said balloon is inflated wherein said balloon is configured to celebrate a holiday, said balloon having a fill port being in fluid communication with an interior of said balloon for inflating or deflating said balloon, said fill port including a closure for closing said fill port thereby facilitating said balloon to remain inflated for an extended period of time, said balloon having a weighted base wherein said weighted base is configured to facilitate said balloon to remain stationary on a support surface;

a plurality of light emitters, each of said plurality of light emitters being integrated into said balloon having each of said plurality of light emitters being directed into an interior of said balloon wherein each of said plurality of light emitters is configured to emit light into said balloon for illuminating said interior of said balloon;

a charger having a panel and a stake extending downwardly from a bottom surface of said panel, said stake tapering to a pointed end wherein said pointed end is configured to penetrate the support surface having said panel being spaced upwardly from the support surface, said charger being in communication with said plurality of light emitters;

wherein said balloon has an outer wall which has a series of spherical portions that are distributed between a top end and a bottom end of said balloon such that said balloon has the ornamental appearance of a snowman;

wherein said outer wall has a pair of arm portions each extending in opposite directions from a middle one of said plurality of spherical portions, each of said arm portions being forked wherein each of said arm portions is configured to have the ornamental appearance of sticks used as snowman arms; and wherein said balloon has a chamber integrated into a bottom one of said spherical portions of said outer wall having said chamber being aligned with said bottom end of said balloon, said bottom end being flattened such that said bottom end defines said weighted base, said chamber further having a peripheral wall perpendicular to said bottom end, said peripheral wall extending from said bottom end to a base of said bottom one of said spherical portions, said chamber being filled with a granular material wherein said granular material is configured to inhibit said balloon from tipping over when said balloon is stood upon said bottom end.

2. The device according to claim 1, wherein:

said fill port extends through said outer wall associated with said bottom spherical portion at a point positioned closer to said bottom end than said middle spherical portion;

said outer wall has a ridge extending outwardly from a top one of said spherical portions and a cylindrical portion extending upwardly from said ridge wherein said ridge and said cylindrical portion are configured to have the ornamental appearance of a top hat; and said outer wall has a pair of anchors each extending laterally away in opposite directions from said middle spherical portion wherein each of said anchors is configured to be attached to a respective one of a pair of anchoring wires to secure said balloon in a selected location.

3. The device according to claim 1, wherein each of said light emitters is attached to an inside surface of said outer wall corresponding to a respective one of said bottom spherical portion and said middle spherical portion.

4. The device according to claim 1, wherein said charger includes:

a solar panel being integrated into a top surface of said panel wherein said solar panel is configured to be exposed to sunlight when said stake is inserted into the support surface;

a rechargeable battery being integrated into said panel, said rechargeable battery being electrically coupled to said solar panel thereby facilitating said solar panel to charge said rechargeable battery; and a power cord being coupled between said panel and said balloon, said power cord being electrically coupled to said rechargeable battery, said power cord being electrically coupled to each of said plurality of light emitters.

5. An inflatable holiday decoration device being positionable anywhere without being tethered to an electrical outlet, said device comprising:

a balloon being structured to resemble a holiday character when said balloon is inflated wherein said balloon is configured to celebrate a holiday, said balloon having a fill port being in fluid communication with an interior of said balloon for inflating or deflating said balloon, said fill port including a closure for closing said fill port thereby facilitating said balloon to remain inflated for an extended period of time, said balloon having a weighted base wherein said weighted base is configured to facilitate said balloon to remain stationary on a support surface, said balloon having an outer wall which has a series of spherical portions that are distributed between a top end and a bottom end of said balloon such that said balloon has the ornamental appearance of a snowman, said outer wall having a pair of arm portions each extending in opposite directions from a middle one of said plurality of spherical portions, each of said arm portions being forked wherein each of said arm portions is configured to have the ornamental appearance of sticks used as snowman arms, said balloon having a chamber integrated into a bottom one of said spherical portions of said outer wall having said chamber being aligned with said bottom end of said balloon, said bottom end being flattened such that said bottom end defines said weighted base, said chamber further having a peripheral wall perpendicular to said bottom end, said peripheral wall extending from said bottom end to a base of said bottom one of said spherical portions, said chamber being filled with a granular material wherein said granular material is configured to inhibit said balloon from tipping over when said balloon is stood upon said bottom end, said fill port extending through said outer wall associated with said bottom spherical portion at a point positioned closer to said bottom end than said middle spherical portion, said outer wall having a ridge extending outwardly from a top one of said spherical portions and a cylindrical portion extending upwardly from said ridge wherein said ridge and said cylindrical portion are configured to have the ornamental appearance of a top hat, said outer wall having a pair of anchors each extending laterally away in opposite directions from said middle spherical portion wherein each of said anchors is configured to be attached to a respective one of a pair of anchoring wires to secure said balloon in a selected location;

a plurality of light emitters, each of said plurality of light emitters being integrated into said balloon having each of said plurality of light emitters being directed into an interior of said balloon wherein each of said plurality of light emitters is configured to emit light into said balloon for illuminating said interior of said balloon, each of said light emitters being attached to an inside surface of said outer wall corresponding to a respective one of said bottom spherical portion and said middle spherical portion;

a charger having a panel and a stake extending downwardly from a bottom surface of said panel, said stake tapering to a pointed end wherein said pointed end is configured to penetrate the support surface having said panel being spaced upwardly from the support surface;

a solar panel being integrated into a top surface of said panel wherein said solar panel is configured to be exposed to sunlight when said stake is inserted into the support surface;

a rechargeable battery being integrated into said panel, said rechargeable battery being electrically coupled to said solar panel thereby facilitating said solar panel to charge said rechargeable battery; and a power cord being coupled between said panel and said bottom spherical portion of said outer wall of said balloon, said power cord being electrically coupled to said rechargeable battery, said power cord being electrically coupled to each of said plurality of light emitters.

* * * * *